US006452325B1

(12) United States Patent
Dupont

(10) Patent No.: US 6,452,325 B1
(45) Date of Patent: Sep. 17, 2002

(54) SHATTERPROOFING OF FLUORESCENT LAMPS

(75) Inventor: Paul Robert Dupont, Andover, NJ (US)

(73) Assignee: Thermoplastic Processes, Inc., Stirling, NJ (US)

( * ) Notice: Subject to any disclaimer, the term of this patent is extended or adjusted under 35 U.S.C. 154(b) by 86 days.

(21) Appl. No.: 09/644,163

(22) Filed: Aug. 22, 2000

Related U.S. Application Data

(63) Continuation-in-part of application No. 09/621,835, filed on Jul. 24, 2000, now abandoned.

(51) Int. Cl.[7] ..... H01J 61/30
(52) U.S. Cl. ..... 313/489; 313/635; 313/493
(58) Field of Search ..... 313/110, 479, 313/489, 635, 572, 312, 493; 220/2.1 R

(56) References Cited

U.S. PATENT DOCUMENTS

| | | | | | |
|---|---|---|---|---|---|
| 3,673,401 | A | * | 6/1972 | Du Pont | 313/312 |
| 4,048,537 | A | * | 9/1977 | Blaisdell et al. | 313/489 |
| 4,924,368 | A | * | 5/1990 | Northrop et al. | 313/110 |
| 5,173,637 | A | * | 12/1992 | Sica | 313/25 |
| 5,536,998 | A | * | 7/1996 | Sica | 313/489 |

* cited by examiner

*Primary Examiner*—Ashok Patel
(74) *Attorney, Agent, or Firm*—Howard R. Popper

(57) ABSTRACT

A compact and portable docking station for a radio mobile personal digital assistant (PDA) carries a magnetic card reader and provides an interface that supplies drive power to the magnetic card reader independently of the PDA battery and translates signal levels provided from the card reader so that they can reliably be read by the PDA. PDA battery power is conserved by initiating all interface actions from a software generated "radio" button appearing on the screen of the PDA.

5 Claims, 4 Drawing Sheets

SHATTERPROOFING OF FLUORESCENT LAMPS

REFERENCE TO RELATED APPLICATION

This application is a continuation-in-part of application Ser. No. 09/621,835, filed Jul. 24, 2000, now abandoned.

FIELD OF THE INVENTION

This invention relates to fluorescent lamps and, more particularly, to the shatter-proofing of fluorescent lamps.

BACKGROUND Of THE INVENTION

In my previous U.S. Pat. No. 3,673,401 I disclosed an arrangement in which a fluorescent lamp could be rendered shatterproof by using a cylindrical transparent and non-frangible shield of polymeric material together with two rubber-like plastic end-caps. The cylindrical shield was made from a length of extruded plastic tubing having a diameter suitable for each size of fluorescent lamp and the end-caps were provided with a peripheral rib or flange to abut the end of the cylindrical tubing. The arrangement required hand assembly involving several steps. First, one of the end-caps was friction fitted onto the metallic ferrule at one end of the fluorescent lamp. Next, the cylindrical shield was said over the fluorescent lamp until its end abutted the peripheral rib. Finally, the second end cap was friction fitted over the opposite metallic ferrule and its position adjusted until its peripheral rib abutted the opposite end of the cylindrical shield. Reliability of the shatterproofing depended on how carefully the four elements were put together by the user. If the fluorescent lamp were dropped or fell from its fixture so that its glass envelope broke, the shards of glass as well as the phosphorescent powders and mercury used in the lamp could all be contained. This type of shatterproof fluorescent lamp assembly became very popular in industrial settings, especially those which had to be safeguarded against contamination by toxic particulates and materials.

More recently patents have been issued directed to making the assembly hold together more securely. Thus, U.S. Pat. Nos. 5,173,637 and 4,924,368 teach that an adhesive should be applied to the exterior of the metallic ferrule of the lamp so as to cause the end cap to better adhere to the lamp. While the use of adhesive allowed greater tolerances to be employed in the fabrication of the end-cap and thus facilitated assembly as compared to using an end-cap whose inner diameter was friction-fitted to tightly embrace the metallic ferrule, the assembly operation remained a somewhat tedious hand operation requiring the lighting maintenance personnel to manually put together the elements of the fluorescent lamp protection assembly in the field rather than merely replacing burned-out lamps. It would be advantageous to eliminate the need for field assembly as well as to provide a more reliable encapsulation method.

SUMMARY OF THE INVENTION

In accordance with the principles of the present invention, as exemplified by the illustrative embodiment, a shatterproof fluorescent lamp assembly is achieved capable of containing within a polymeric envelope all of the glass, powders and mercury used in the lamp without the need for separate, hand-assembled tubes and end-caps. Instead of manually fitting together end caps to a length of pre-cut, cylindrical tubing, a protective polymeric coating, advantageously a polycarbonate, is extruded directly on to the fluorescent lamp so as to be in intimately conforming contact with substantially all of the contours of the lamp's glass envelope and metallic ferrules. The lamp is passed through an air lock into the main lumen bore of an extruder crosshead which is connected to vacuum pump. A cylinder of hot, polymeric material is extruded and radially drawn inward toward the periphery of the lamp by the vacuum. The extruded cylinder should have a wall thickness, so that when cooled, it will exhibit sufficient beam strength to maintain the cylindrical shape even if the glass envelope of the fluorescent tube is shattered.

Prior to inserting the fluorescent lamp into the crosshead, a short length of easily removable silicone tubing is fitted over the electrical terminals at each end of the lamp to protect the terminals from being permanently coated with any plastic.so. According to one embodiment, the metallic ferrules of the lamp are pre-coated with an adhesive which, advantageously, may be a heat-activated adhesive. According to another embodiment, instead of using an adhesive, each end of the lamp is heated and then immersed in an air-fluidized bed of powdered ethylene vinyl acetate to pre-coat the metallic ferrules of the lamp. In either case, the lamp is then put through the extruder crosshead to receive the cylindrical sheath which adheres to the pre-coated portions of the lamp ends. Advantageously, as the trailing end of the first fluorescent lamp enters the crosshead, a second fluorescent lamp is inserted so as to make the process continuous for a number of successive lamps. At a convenient distance downstream from the crosshead, power driven rollers move the encapsulated lamp to a first cutting position where the extrudate between successive lamp ends is sheared, separating the encapsulated lamps from one another. A second cutting operation cuts the extrudate at the end of the lamp ferrule to facilitate removal of the silicone tubing covering the electrical terminals. The coated, shatterproofed lamps may then be packed for shipment. By immersing the lamp ends in the air-fluidized bed of powdered plastic to which the extrudate adheres, the ends as well as the glass envelope of the fluorescent lamp are substantially completely encapsulated.

BRIEF DESCRIPTION OF THE DRAWING

The foregoing objects and features of the present invention may become more apparent from a reading of the ensuing description, together with the drawing, in which.

DESCRIPTION

Figure 1:
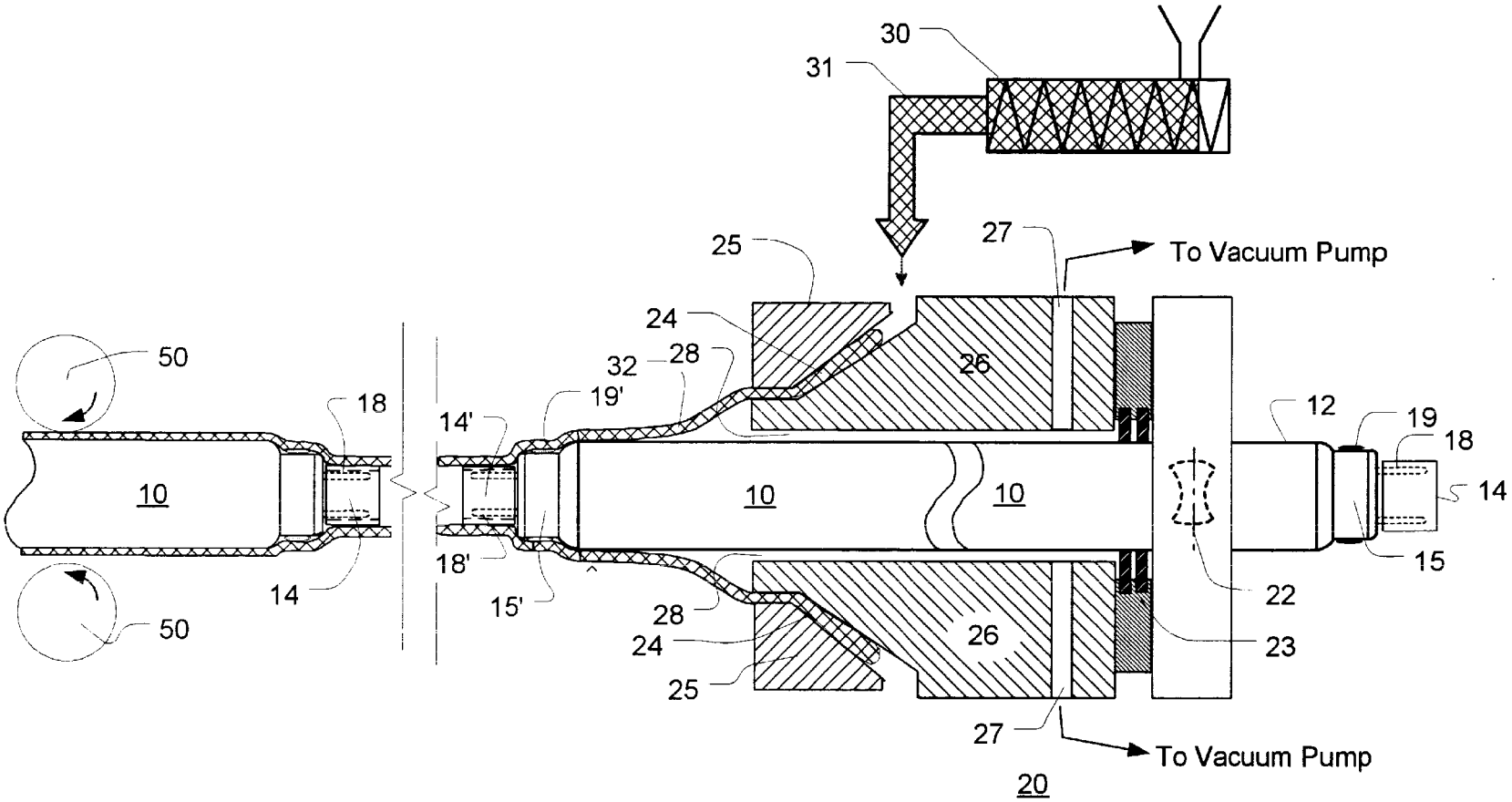
FIG. 1 is an overall view showing the encapsulation method of the invention.

In FIG. 1, a conventional, commercially available fluorescent lamp 10 is depicted during its passage through the encapsulating apparatus of the invention. Lamp 10 includes an elongated glass tube 12 that necks down slightly at each end to engage a metallic ferrule 15. Fluorescent lamps are conventionally equipped with either a single electrical terminal or, as shown, a pair of electrical terminals 18, 18' at each end.

As shown in my previous patent, the prior art the practice was to enclose the glass tube portion 12 of the fluorescent lamp 10 within a larger diameter sleeve made of a semi-rigid, nonfrangible transparent tubing of polymeric material. The protective sleeve was secured to the ferrules 15 by means of rubber end caps that were frictionally fit over the cups. In the prior art it was always thought to be necessary to have the diameter of the protective sleeve larger than the outside diameter of the glass envelope not only to facilitate assembly, but also to provide an "air gap" for various purposes. In accordance with the invention, there is no need for such an air gap, and no need for end caps and a hand fitting and assembly operation to be performed in the field. Instead, referring to FIG. 1 (not drawn to scale), plastic is extruded over fluorescent lamp 10 to encapsulate the lamp as it passes through crosshead 20 connected to a screw extruder 30.

Prior to introducing lamp 10 into crosshead 20, an adhesive 19 is applied to the circumference of the metallic ferrules 15, 15' at each end of the lamp. Advantageously, the adhesive may be applied to lap over a small portion of the end wall of the ferrule. Then the lamp is introduced into cross-head 20 through an air lock which advantageously includes a stage of feed-through rollers 22 and an air seal 23 (shown in fuller detail in FIGS. 5 and 6 respectively). As lamp 10 passes through crosshead 20, extruder 30 injects molten thermoplastic material 31 under pressure into the annular space 24 between crosshead parts 25 and 26. A cylinder of hot, plastic material 32 is extruded from crosshead 20. At the same time, vacuum is applied to ports 27 leading to the main bore 28 of the crosshead. Because of the sealing action of air lock 22, 23, the vacuum causes the extruded cylinder of hot, plastic material 32 to be drawn radially inward into intimately conforming contact with the outer surfaces of lamp 10. In sequence, as the short length of protective tubing 14' exits crosshead 20 it is first contacted by the inwardly drawn extruded material 32, bonding thereto. Next, ferrule 15', glass envelope 12, ferrules 15 and, finally, the short length of protective tubing 14 are encapsulated as they exit bore 28 of extruder crosshead 20. The heat of the plastic material 32 emerging from crosshead 20 activates adhesive 19 aiding the adhesion of the extruded material to ferrules 15' and 15.

Figure 2:
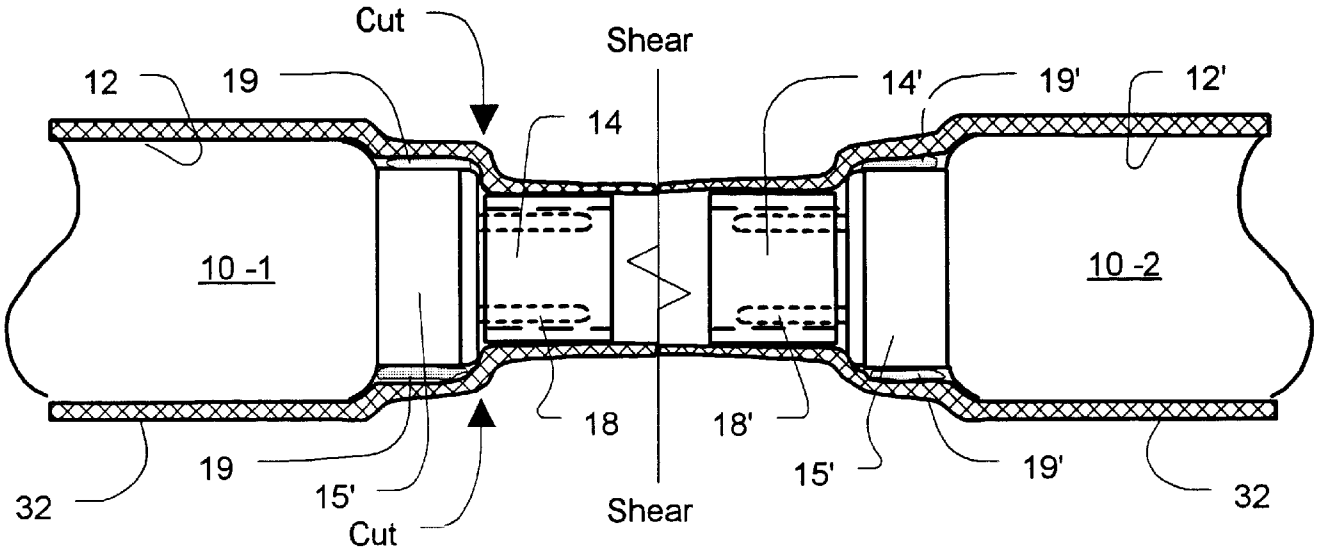
FIG. 2 shows a section through a sequence of encapsulated fluorescent lamps after passing through the crosshead apparatus of FIG. 1, but prior to the sequence of encapsulated lamps being cut apart.
Figure 3:
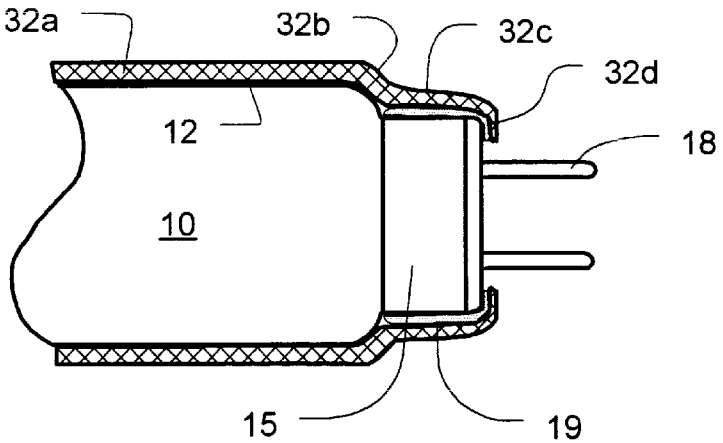
FIG. 3 shows an enlarged view of the end of an encapsulated fluorescent lamp after separation and removal of the temporary protective tubing from the electrical terminals.

As soon as the trailing end of a first lamp 10-1 is processed in crosshead 20, it is advantageous to introduce a second lamp 10-2 into crosshead 20 through air lock 22, 23 so that it can be encapsulated in similar fashion to the first lamp in a continuous extrusion process wherein a sequence of encapsulated lamps follow one another from the extruder crosshead. At a convenient distance downstream from crosshead 20 a set of power driven take-up rolls 50 grasps the encapsulated lamp 10-1, drawing it away from the extruder and, to some extent, causing some thinning of the wall thickness of the extruded material at the ends of the lamp, as shown more clearly in the enlarged views of FIGS. 2 and 3. Thereafter, the sequence of encapsulated lamps is cut apart. Advantageously, this is done in two steps. In the first step, as shown in FIG. 2, the encapsulating sleeve 32 is cut between successive lamps 10-1 and 10-2 along the line "cut—cut". At this point a lamp still has its electrical contacts covered by the short lengths of protective tubing 14, 14'. In the second step, the wall thicknesses of the encapsulating sleeve 32 is cut through between the end of each ferrule 15, 15' and the end of the respective protective tubing 14, 14' so that the protective tubing 14, 14' can be removed from each end of lamp 10. FIG. 3 shows the encapsulated lamp 10 with the protective tubing 14 removed. Note that coating 32 intimately embraces the various contours of lamp 10 at points 32*a*, 32*b*, 32*c* and 32*d* thereby providing complete containment for all of the lamps internal components should its glass envelope 12 be broken. At this point the encapsulated lamp may be packed and shipped to the field where it may be installed without any additional labor being required.

Figure 6:
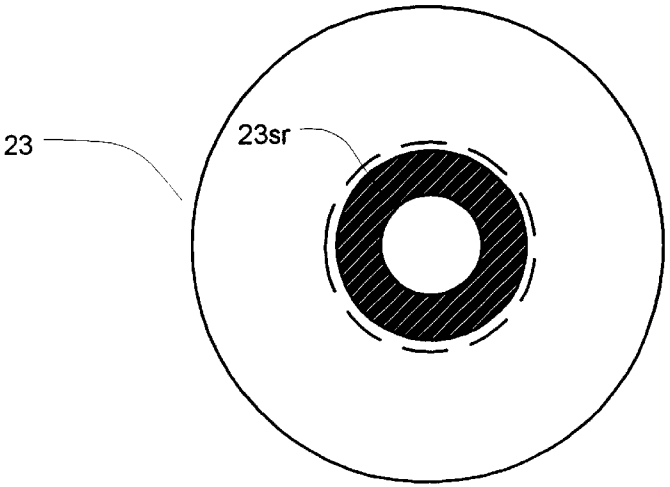
FIG. 6 shows the air lock seal of the crosshead.
Figure 5:
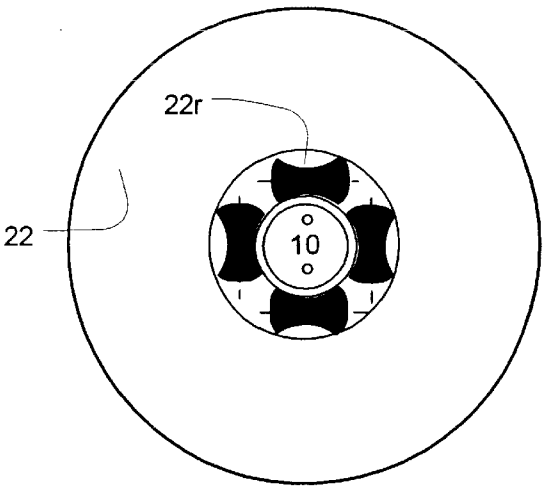
FIG. 5 shows the rollers of the air lock.
Figure 4:
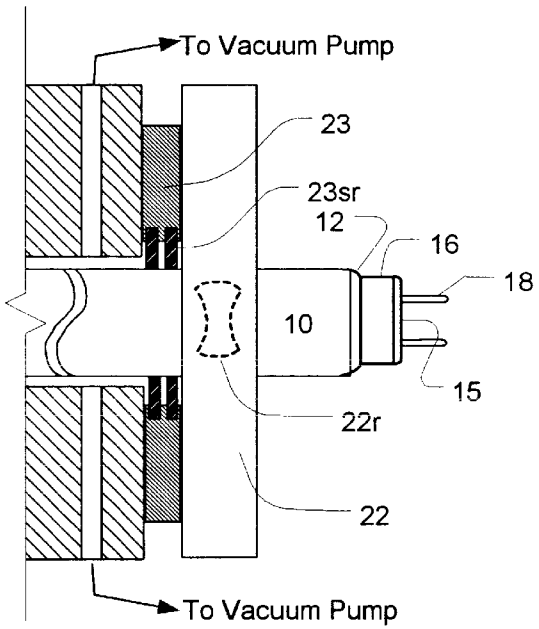
FIG. 4 show a section through the air lock of the crosshead.

FIGS. 4, 5 and 6 show details of the air lock 22, 23 at the input end of crosshead 20 through which fluorescent lamps are introduced for encapsulation. An array of rollers 22*r* is provided to help axially align the lamp 10 with the internal bore of 28 of the crosshead. Rollers 22*r* are advantageously made of rubber like material to assist in guiding the glass envelope 12 of lamp 10 through the crosshead. Rollers 22*r* may advantageously be power driven. An air seal 22 having one or more sealing rings 22*sr* whose inner diameter is made slightly smaller than the outer diameter of the glass envelope 12 to minimize air leakage into the bore 28 of the crosshead.

Figure 7:
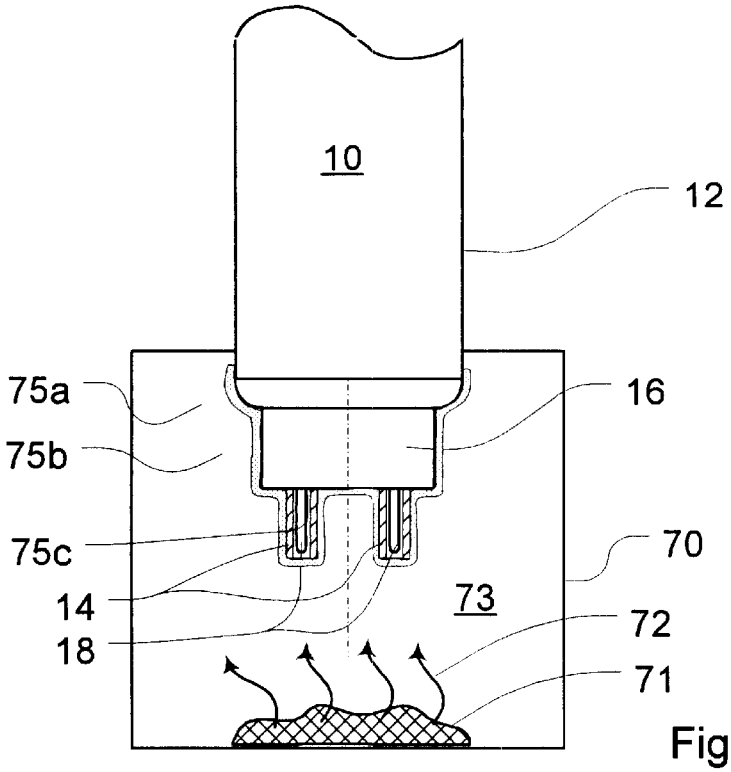
FIG. 7 shows the end of a fluorescent lamp immersed in an air-fluidized bed of powdered plastic to provide a coating to which the extrudate will adhere.
Figure 8:
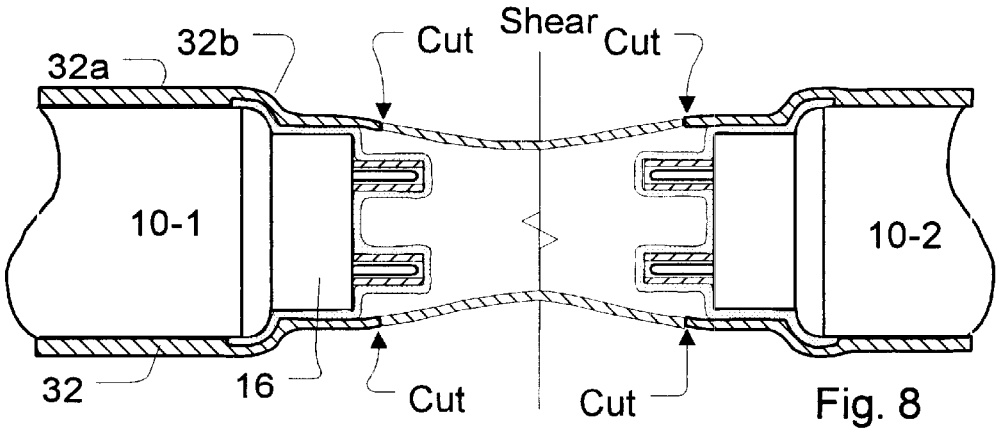
FIG. 8 shows the lamps which have been treated in FIG. 7 after emerging from the extruder crosshead.
Figure 9:
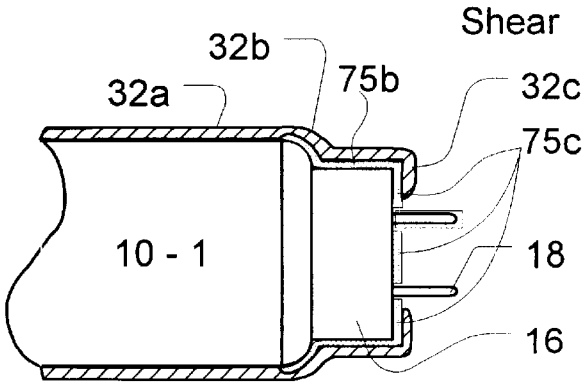
FIG. 9 shows the lamp end after the silicone protective sleeve has been removed.

Referring now to FIGS. 7 through 9 an alternative process for encapsulating fluorescent lamps is disclosed. First, a protective silicone sleeve 14 is slipped over the electrical terminals of the lamp. Then a short length at the ends of each lamp 10 is heated, advantageously by being exposed to an infra-red heat source (not shown). The heated end portion of the lamp should embrace the end ferrule 16 and a short length of the glass envelope 12. The heated end portion is then immersed in a container 70 containing an air stone 71 and a quantity of plastic powder, advantageously ethylene vinyl acetate which has been freeze dried and ground into powder. Air stone 71 may advantageously be similar to the type often employed in aquariums. Air stone 71 is connected to an air supply (not shown) to produce upwardly directed air streams 72 that turn the plastic powder into a cloud or air-fluidized plastic bed 73. The air-fluidized powder adheres to the heated lamp end thereby providing a pre-coating 75*a*, 75*b* and 75*c*. Portion 75*a* adheres to the end portion of glass tube 12, portion 75*b* adheres to the ferrule 16 and portion 75*c* adheres to the transverse part of the terminal-bearing portion of the lamp.

The pre-coated lamp end is then inserted into the crosshead of the extruder to receive the extruded main cylindrical coating 32, as described above. Referring to FIG. 8, portion 32*a* of the extruded coating adheres to the cylindrical portion of glass envelope 12. Portion 32*b* of the extruded coating adheres to the transitional portion of the glass envelope 12 which has now been coated with coating 75*a*. Similarly, Portion 32*c* of the extruded coating now adheres to the precoated ferrule portions 75*b* of lamp 10.

As described above, after a first lamp 10-1 has exited the crosshead, a second lamp 10-2, also having its ends pre-coated with coating 75, may advantageously be inserted into the crosshead. FIG. 8 show a succession of lamps 10-1, 10-2 encapsulated by coating 32, after having exited the extruder. FIG. 9 shows a lamp end after the coating 32 between successive lamps 10-1 and 10-2 has been sheared and after the protective silicone sleeves 14 have been removed. Coating 32 is then trimmed at the "cut" lines shown in FIG. 8.

This embodiment of the invention has the advantage that the extrudate 32 and pre-coating 75 adhering to each other, especially at point 32*c* and 75*c*, provide a more complete encapsulation of the lamp 10.

The foregoing is deemed to be illustrative of the principles of the invention. It should be apparent that the polymeric extrudate 32 may be made of polyethylene, acrylic, PETG, polycarbonate or any other similar material with a wall thickness affording sufficient beam strength to retain its cylindrical shape should the glass envelope be fractured. In particular, it should be noted that while fluorescent lamps are no longer manufactured in a variety of colors because of environmental concerns caused by the metallic compounds used in some colored fluorescent powders, such powders may safely be incorporated in the extrudate since they are completely encapsulated in the plastic coating itself Accordingly, a variety of differently colored plastic envelopes may be extruded over a white fluorescent lamp. In one illustrative embodiment, the polymeric coating 32, as shown in FIG. 3, had a wall thickness 32 of approximately 0.0151", a wall thickness 32*b* of approximately 0.016" and a wall thickness 32*c* at the end of ferrule 15 of approximately 0.006". It should be appreciated that the interior diameter of protective tubing 14 should fit snugly over contacts 18 and that the end of tubing 14 may be spaced apart from the end wall of the ferrule to facilitate cutting through of the extrudate 32. Further and other modifications maybe made by those skilled in the art without, however, departing from the spirit and scope of the invention.

What is claimed is:

1. A shatter resistant fluorescent lamp having a polymeric coating extruded upon and in intimately conforming embracing contact with the exterior surfaces of the lamp.

2. A shatter resistant fluorescent lamp according to claim 1 having a glass envelope and a ferrule at each end, wherein the extruded coating is in intimately conforming embracing contact with the exterior surfaces of said glass envelope and said ferrule.

3. A shatter resistant fluorescent lamp according to claim 2 including an adherent applied to said ferrule for adhering said extruded coating to said ferrule.

4. A shatter resistant fluorescent lamp according to claim 3 wherein said adherent is an adhesive.

5. A shatter resistant fluorescent lamp according to claim 4 wherein said adhesive is heat activated.

* * * * *

UNITED STATES PATENT AND TRADEMARK OFFICE

CERTIFICATE OF CORRECTION

PATENT NO. : 6,452,325 B1
DATED : September 17, 2001
INVENTOR(S) : Paul Robert Dupont It is certified that error appears in the above-identified patent and that said Letters Patent is hereby corrected as shown below:

Title page,
Item [57], ABSTRACT, delete ABSTRACT and replace with new ABSTRACT as follows:

-- ABSTRACT

A shatterproof fluorescent lamp is produced by extruding a polymeric coating over the lamp so that it intimately embraces substantially all of the external contours of the lamp, including its glass envelope and end-ferrules. The lamp is passed through an air lock into the main lumen of a crosshead which extrudes a cylinder of hot plastic that is radially drawn inward toward the lumen axis by an applied vacuum. A continuous chain of encapsulated lamps emerges from the crosshead that then may be cut apart to reveal individually completely encapsulated lamps. --

Signed and Sealed this

Ninth Day of September, 2003

JAMES E. ROGAN
*Director of the United States Patent and Trademark Office*